US006186221B1

(12) United States Patent
Beauregard et al.

(10) Patent No.: US 6,186,221 B1
(45) **Date of Patent: *Feb. 13, 2001**

(54) HEAT RECOVERY ASSEMBLY

(75) Inventors: Raymond L. Beauregard, Middletown; Thomas P. Mastronarde, South Windsor, both of CT (US)

(73) Assignee: Combustion Engineering, Inc., Windsor, CT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/022,702

(22) Filed: Feb. 12, 1998

(51) Int. Cl.[7] ..... F28D 7/16; F22B 37/24
(52) U.S. Cl. ..... 165/82; 165/162; 122/510
(58) Field of Search ..... 165/82, 162, 172; 122/510

(56) References Cited

U.S. PATENT DOCUMENTS

| | | | | |
|---|---|---|---|---|
| 1,852,363 | * | 4/1932 | Parent | 165/172 X |
| 1,855,552 | * | 4/1932 | Jacocks et al. | 165/82 X |
| 2,088,931 | * | 8/1937 | Sengstaken | 165/162 X |
| 2,554,130 | * | 5/1951 | Strunk | 165/82 |
| 2,847,192 | * | 8/1958 | Smith et al. | 165/172 X |
| 2,876,975 | * | 3/1959 | Short | 165/82 X |
| 4,036,289 | * | 7/1977 | Cheng et al. | 165/82 |
| 4,184,862 | * | 1/1980 | Waters | 165/162 X |
| 4,246,872 | * | 1/1981 | Skinner et al. | 165/162 X |
| 4,262,705 | | 4/1981 | Skinner et al. . | |
| 4,433,722 | * | 2/1984 | Fueglister | 165/162 |
| 4,619,315 | * | 10/1986 | Waryasz | 165/162 X |
| 4,685,511 | * | 8/1987 | Sabatino | 165/82 |

FOREIGN PATENT DOCUMENTS

| | | | | |
|---|---|---|---|---|
| 331436 | * | 9/1903 | (FR) | 165/172 |
| 985595 | * | 12/1982 | (SU) | 165/82 |

OTHER PUBLICATIONS

Patent Abstracts of Japan, vol. 010, No. 122 (M–476), May 7, 1986 & JP 60 251388 A (Toshiba KK), Dec. 12, 1985.

B. Gericke: "Abhitzedampf Erzeugersysteme: Bauelemente in verfahrenstechnischen Prozessen; Teil II: Abhitzesysteme für den, Mitteltemperaturbereich" BWK Brennstoff Warme Kraft. vol. 35, No. 12, Dec. 1983, pp. 499–504, XP002103730.

* cited by examiner

*Primary Examiner*—Leonard Leo
(74) *Attorney, Agent, or Firm*—Alix, Yale & Ristas, LLP

(57) ABSTRACT

A combined cycle system has a gas turbine for generating an exhaust gas stream and a heat recovery steam generator with a housing for defining a horizontal exhaust gas flow path for the exhaust gas stream. Positioned within the housing is a heat recovery assembly having vertical rows of horizontally oriented heat transfer tubes transverse to the direction of gas flow and spaced apart in the direction of the gas flow path. The heat transfer tubes are supported by a plurality of vertical support plate assemblies oriented parallel to the exhaust flow path. Each support plate assembly has a plurality of coplanar support plate segments, each support plate segment supporting less than three rows of heat transfer tubes.

2 Claims, 3 Drawing Sheets

HEAT RECOVERY ASSEMBLY

FIELD OF THE INVENTION

This invention relates to the field of combined cycle systems having a gas turbine and an associated heat recovery steam generator. More particularly, this invention relates to a heat recovery assembly for use in a heat recovery steam generator.

BACKGROUND OF THE INVENTION

Gas turbines have been widely used to provide electrical power, usually as a standby for both peak power and reserve power requirements in the utility industry. Gas turbines are preferred because of their rapid starting capability and low capital costs. Conventional gas turbines, however, operate with reduced thermal efficiency due to the high exit temperatures of the exhaust gas stream and the resulting thermal loss. Therefore, a gas turbine is often combined with the heat recovery steam generator to improve overall system efficiency.

The heat recovery steam generator can be employed to drive a steam turbine for power output or to provide process steam in cogeneration cycles. Heat recovery steam generators typically have either a vertical exhaust gas flow or a horizontal exhaust gas flow through arrangements of heat recovery and air pollution control assemblies. The heat recovery assemblies, or heat exchange circuits, conventionally include superheaters, evaporators, economizers and preheaters. In heat recovery steam generators having vertical exhaust gas flow, the exhaust gas stream from the gas turbine flows upward through stacked arrangements of heat recovery assemblies and air pollution control assemblies. These heat recovery assemblies of the heat recovery steam generators having vertical exhaust gas flow employ horizontally oriented heat transfer tubes. The horizontally oriented heat transfer tubes have forced circulation of a heat transfer fluid therethrough. The use of horizontally oriented heat transfer tubes having forced circulation can permit rapid start up of the heat recovery steam generator.

Conventionally, in a heat recovery assembly having horizontal heat transfer tubes, the heat transfer tubes extend through vertical pairs of spaced apart parallel heat transfer tube support plates. The horizontal tubes are arranged in horizontal rows, a conventional heat recovery assembly having many rows. Typically, a heat transfer assembly has more than 20 rows of heat transfer tubes. The heat transfer tube support plates are suspended within the housing. The mechanical load and thermal stresses exerted on the heat transfer tube support plate are in the same vertical direction when a heat recovery assembly with horizontal heat transfer tubes is employed in a heat recovery steam generator with vertical exhaust gas flow. The mechanical stress on the support plates is generally along a vertical line due to the suspended arrangement of the support plates. The thermal gradient and therefore the thermal stresses on the heat transfer tube support plates are generally constant along any given horizontal line, but vary in the vertical direction. The vertical variation in the thermal gradient and therefore the thermal stresses arises from the cooling of the exhaust gas during passage through the heat recovery assembly.

The support plates are free to expand down as the heat recovery assembly heats up due to the suspension of the support plates in the housing. The resulting downward expansion and therefore the thermal stress is in a generally uniform manner. The thermal expansion of the upper portion of the support plate will be less than the thermal expansion of the lower portion of the support plate due to the variation of the thermal gradient along a vertical line. Again, however, the thermal expansion along any given horizontal line is uniform resulting in a uniform downward expansion of the support plate.

Heat recovery steam generators having horizontal exhaust gas flow have vertically upright heat recovery and air pollution control assemblies. The heat transfer tubes of the heat recovery assemblies are vertically oriented and have natural circulation of the heat transfer fluid therethrough. Horizontal exhaust gas flow is particularly preferred for heat recovery steam generators having limitations on height or structure compared to the height or structure typically required for a vertically oriented exhaust gas flow path.

The use of a conventional heat recovery assembly having horizontally oriented heat transfer tubes in a heat recovery steam generator having a horizontal gas flow results in distortion or warpage of the conventional heat transfer tube support plates. The support plate of a conventional heat recovery assembly having horizontal heat transfer tubes is relatively wide, supporting many rows of heat transfer tubes. Typically, a heat recovery assembly has more than 20 rows of heat transfer tubes. The mechanical load on the heat transfer tube support plates is in the vertical direction due to the suspension of the support plates within the housing. The thermal gradient on the support plate is generally constant along a vertical line in contrast to a vertical exhaust gas flow wherein the thermal gradient is generally constant along a horizontal line. In the horizontal exhaust gas arrangement, the thermal gradient varies along any given horizontal line of the support plate as the horizontally flowing exhaust gas is cooled by passage through the heat recovery assembly. As a result, the portion of the support plate in the upstream direction will generally expand vertically downward a greater amount than the support plate portion in the horizontal downstream direction due to the upstream portion having a generally higher temperature. Therefore, the mechanical and thermal stresses within the support plate are perpendicular to each other. The result of the non-parallel arrangement of the mechanical and thermal stresses is the distortion or warpage of the support plate and the potential for failure of the heat transfer tubes.

SUMMARY OF THE INVENTION

Briefly stated, the combined cycle system in accordance with the invention has a gas turbine and heat recovery steam generator having horizontal exhaust gas flow with a horizontal tube heat transfer assembly with segmented heat transfer tube support plates for the support of horizontally oriented heat transfer tubes. The heat transfer assembly with horizontally oriented heat transfer tubes is preferably positioned as the first heat transfer assembly in the upstream direction of the exhaust gas flow, but can alternately or additionally be positioned in the downstream direction of the exhaust gas flow.

The heat recovery assembly employs a vertically segmented heat transfer support plate assembly whereby the support plate segments are sufficiently horizontally narrow to minimize thermal gradients horizontally across the individual support plate segments and therefore reduce the potential for warpage or distortion of the support plate assembly that could affect the heat transfer tubes mounted thereto.

In the preferred form of the invention, the heat recovery assembly has multiple vertically arranged rows of horizontally oriented heat transfer tubes. The vertically arranged rows are transverse to the direction of the gas flow path and are spaced apart in the direction of the gas flow path. The support plate assembly is vertically segmented parallel to the vertical rows of heat transfer tubes wherein less than three and preferably only two vertical rows of the heat transfer tubes are mounted to each support plate segment. A width for each support plate segment of two vertical rows of heat transfer tubes reduces the thermal gradient across the support plate segment. The reduced thermal gradient substantially reduces the potential for warpage of the individual support plate segments. The reduced warpage of the individual support plate segment reduces the potential for mechanical failure of the heat recovery assembly.

The heat transfer assembly of the invention is employed of heat recovery steam generators having horizontal exhaust gas flow. The use of the heat recovery assembly of the invention having horizontal heat transfer tubes and forced circulation of the heat transfer fluid therethrough allows for a heat recovery steam generator with horizontal exhaust gas flow having rapid start up capabilities compared to conventional heat recovery steam generators with horizontal exhaust gas flow.

An object of the invention is to provide a support plate for use in the heat recovery assembly having horizontally oriented heat transfer tubes with forced circulation of a heat transfer fluid therethrough.

Another object of the invention is to provide a heat transfer tube support plate having a reduced potential warpage when employed with horizontally oriented heat transfer tubes in the heat recovery steam generator having a generally horizontal exhaust gas flow. These and other objects of the invention will become apparent from review of the specification and drawings.

DETAILED DESCRIPTION OF THE INVENTION

Figure 1:
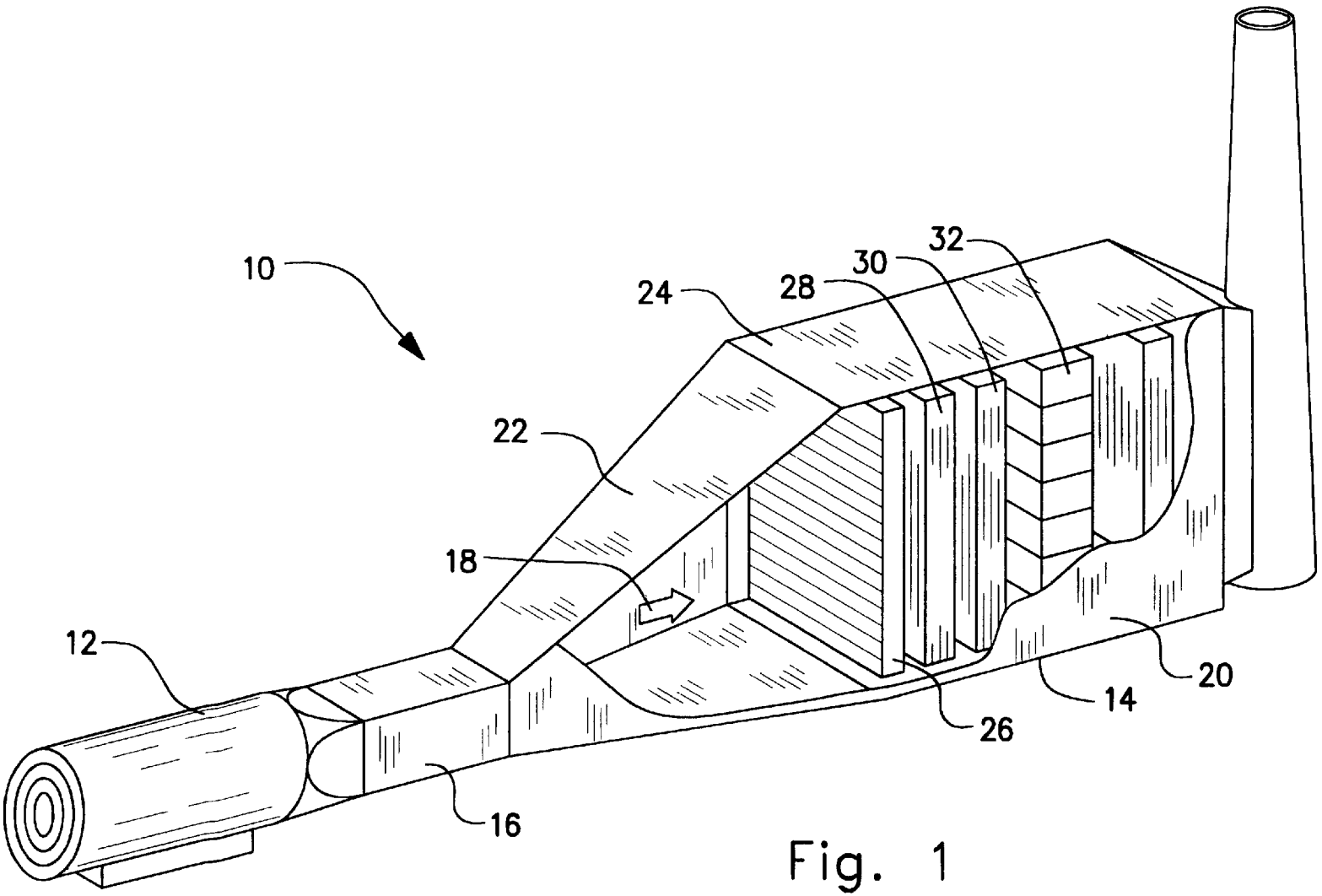
FIG. 1 is a partially cutaway perspective view of a combined cycle system having a gas turbine and a heat recovery steam generator in accordance with the invention.
Figure 2:
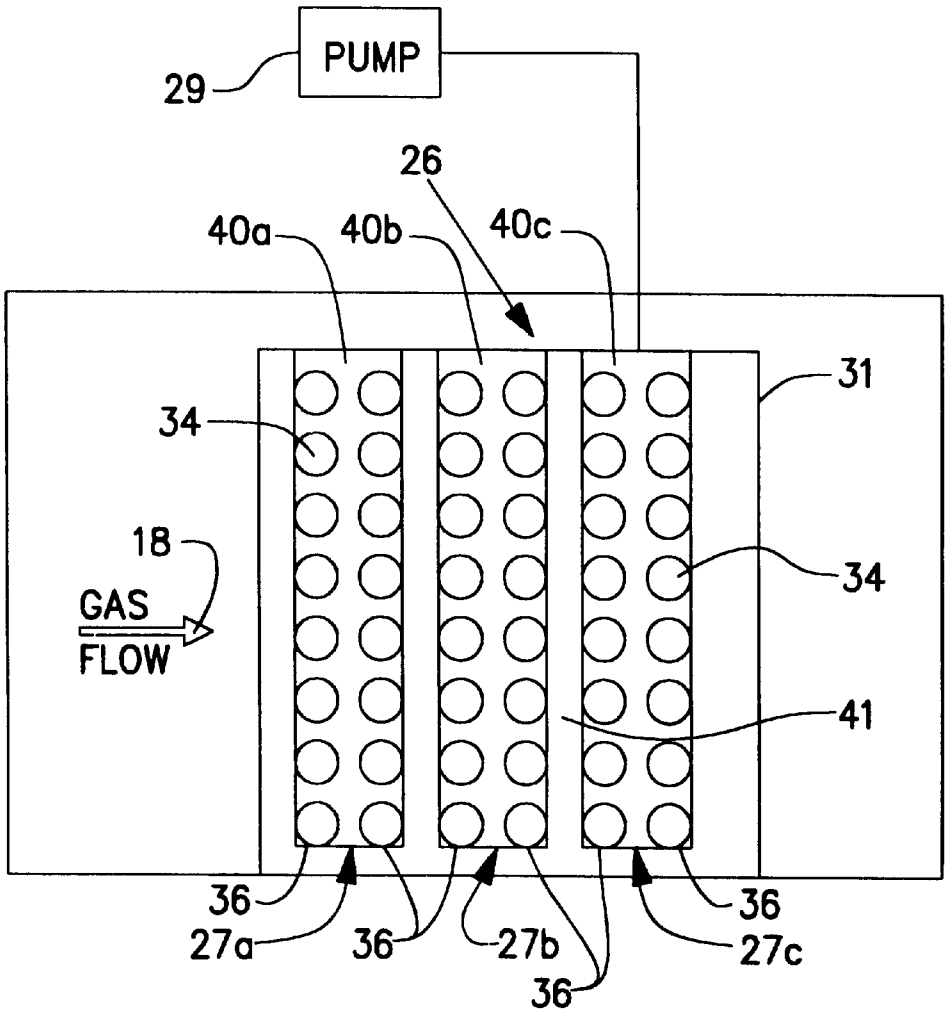
FIG. 2 is an enlarged partial cross-sectional side view of the heat recovery steam generator of FIG. 1.
Figure 3:
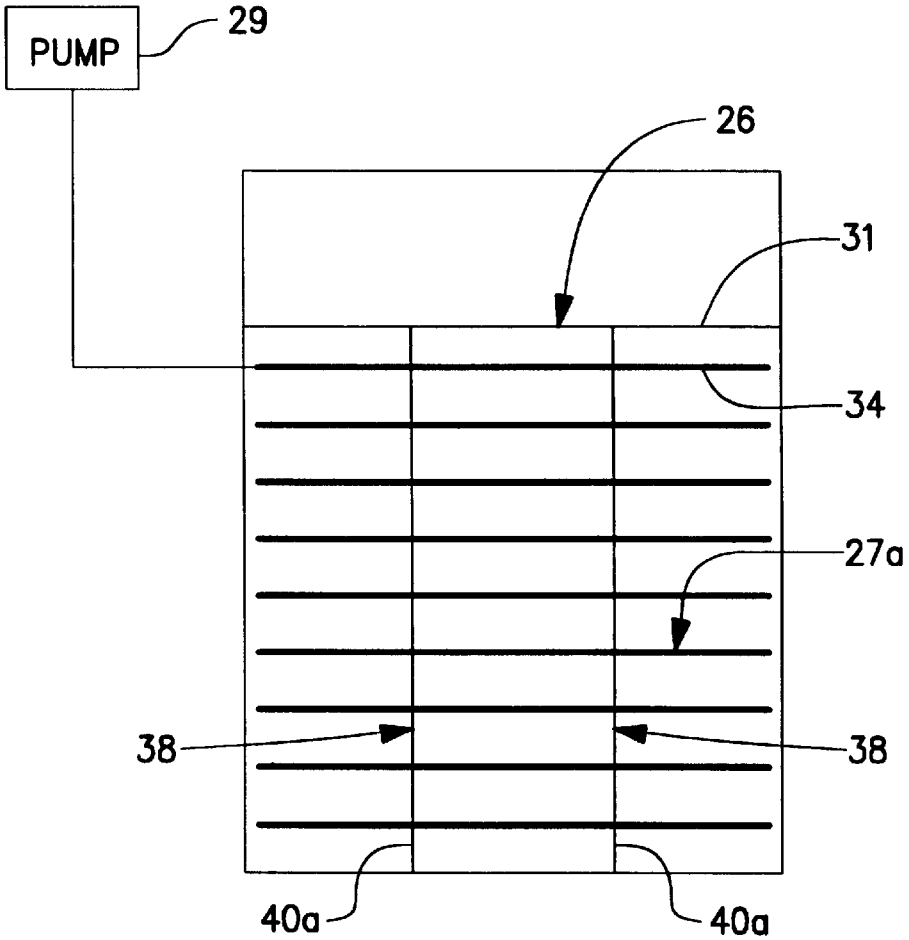
FIG. 3 is an enlarged sectional end on view of the heat recovery steam generator of FIG. 1.

A gas turbine combined cycle system 10 in accordance with the invention has a gas turbine 12 and a heat recovery steam generator 14. A duct 16 directs the exhaust gas stream 18 from the gas turbine 12 to the heat recovery steam generator 14. The heat recovery steam generator 14 has a housing 20 having a diffuser or inlet portion 22 and a full cross-section portion 24. The housing 20 defines a generally horizontal gas flow path therethrough. The inlet portion 22 of the housing 20 expands the exhaust gas stream from the reduced area of the duct 16 to the full cross-section portion 24 of the housing 20.

Positioned within the full cross-section portion 24 is a horizontal tube heat recovery assembly 26. The horizontal tube heat recovery assembly 26 has multiple horizontally oriented heat transfer tubes 34. The tubes 34 are oriented across or perpendicular to the exhaust gas stream 18. A pump 29 circulates a heat transfer fluid through the heat transfer tubes 34. The heat transfer tubes 34 are preferably connected for once through circulation of the heat transfer fluid. The housing 20 contains additional heat recovery assemblies 28, 30 and air pollution control assemblies 32. The horizontal tube heat recovery assembly 26 is preferably positioned at the first circuit or heat recovery unit in the upstream direction, but can be readily employed for heat recovery at any position within the housing 20.

The heat transfer tubes 34 are arranged in parallel vertical rows 36. The rows 36 extend in the downstream direction of the exhaust gas stream 18. The rows 36 of heat transfer tubes 34 are mounted to a pair of transversely spaced apart support plate assemblies 38. The support plate assemblies 38 are perpendicular to the heat transfer tubes 34 and parallel to the exhaust gas stream 1 8. Each support plate assembly 38 is formed of multiple vertically oriented support plate segments 40*a,b,c*. Each support plate segment 40*a,b,c* supports less than three rows 36 of heat transfer tubes 34. Preferably each support plate segment 40*a,b,c* supports two rows 36 of heat transfer tubes 34. The support plate segments 40*a,b,c* are suspended from a support member 31 in a conventional manner well known in the art. The support plate segments 40*a,b,c* of a particular support plate assembly 38 are preferably coplanar. The support plate segments 40*a,b,c* of a particular support plate assembly 38 are further preferably spaced apart in the direction of flow of the exhaust gas stream 18. Plate gaps 41 are therefore defined between the support plate segments 40*a,b,c* to prevent interference between the support plate segments 40*a,b,c* due to thermal expansion of the support plate segments 40*a,b,c* from heating by the exhaust gas stream 18. Each pair of opposed support plate segments 40*a*, 40*a*; 40*b*, 40*b*; and 40*c*, 40*c* of the pair of support plate assemblies 38, together with heat transfer tubes 34 mounted to each pair of support plate segments 40*a*, 40*a*; 40*b*, 40*b*; and 40*c*, 40*c*, form heat recovery assembly segments 27*a,b,c*.

During operation of the heat recovery steam generator 14, the hot exhaust gas stream 18 passes generally horizontally through the rows 36 of heat transfer tubes 34 supported by the support plate assembly 38. The support plate segments 40*a* in the upstream direction of support plate assemblies 38 typically receive the greatest amount of heating from the exhaust gas stream 18. As the exhaust gas stream 18 passes through subsequent heat recovery assembly sections 27*b,c* of the horizontal heat recovery assembly 26, each pair of support plate segments 40*b,c* positioned downstream of a particular support plate assembly 38 receives a lesser degree of heating relative to the upstream support plate segments 40*a*. Therefore, the support plate segments 40*a* in the upstream direction of the exhaust gas stream 18 experiences the greatest thermal expansion and therefore expand vertically downward the greatest relative amount. Support plate segments 40*b,c* positioned further downstream experience a relatively smaller amount of heating and therefore expand vertically downward a smaller relative amount.

The multiple support plate segments 40*a,b,c,* forming the support plate assemblies 38 permit the combination of horizontal gas flow in horizontal heat transfer tubes 34 of the horizontal tube heat recovery assembly 26 without excessive thermal stress on the support plate assemblies 38. Each support plate segment 40*a,b,c* is sufficiently narrow horizontally to reduce the potential for warpage due to thermal gradients in the horizontal direction across the support plate segments 40*a,b,c* in the direction of the exhaust gas stream.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. A heat recovery steam generator comprising:

a housing defining a horizontal exhaust gas flow path;

a plurality of heat recovery assemblies in said housing, at least one of said heat recovery assemblies comprising a plurality of rows of horizontal heat transfer tubes extending transversely across said flow path, said heat exchange tubes in said one heat recovery assembly being supported in said rows by a plurality of heat transfer tube support plate assemblies spaced transversely from each other, each of said support plate assemblies being divided into a plurality of separate support plate segments, each of said support plate segments extending in the direction of said gas flow path and being independently suspended and supporting a portion of said plurality of rows of said heat transfer tubes and said support plate segments of each of said support plate assemblies being coplanar in a plane extending in the direction of said gas flow path and defining vertical plate gaps therebetween for thermal expansion.

2. The heat recovery steam generator of claim 1, wherein each of said support plate segments supports less than three of said rows of said heat transfer tubes.

* * * * *